US007628486B2

(12) United States Patent
Tanaka et al.

(10) Patent No.: US 7,628,486 B2
(45) Date of Patent: Dec. 8, 2009

(54) EYEGLASS LENS PROCESSING METHOD

(75) Inventors: Motoshi Tanaka, Gamagori (JP); Ryoji Shibata, Toyokawa (JP); Takayasu Yamamoto, Aichi (JP)

(73) Assignee: Nidek Co., Ltd., Aichi (JP)

( * ) Notice: Subject to any disclaimer, the term of this patent is extended or adjusted under 35 U.S.C. 154(b) by 248 days.

(21) Appl. No.: 11/863,610

(22) Filed: Sep. 28, 2007

(65) Prior Publication Data

US 2008/0088794 A1 Apr. 17, 2008

(30) Foreign Application Priority Data

Sep. 29, 2006 (JP) ..... 2006-270120

(51) Int. Cl.
*G02C 7/02* (2006.01)

(52) U.S. Cl. ..... 351/177; 351/178; 705/26; 451/43

(58) Field of Classification Search ..... 351/177–178
See application file for complete search history.

(56) References Cited

U.S. PATENT DOCUMENTS

| | | | | |
|---|---|---|---|---|
| 5,333,412 | A | 8/1994 | Matsuyama | |
| 6,142,628 | A | 11/2000 | Saigo | |
| 6,379,215 | B1 | 4/2002 | Mizuno et al. | |
| 6,790,124 | B2 | 9/2004 | Shibata | |
| 6,798,501 | B1 | 9/2004 | Mizuno | |
| 7,448,938 | B2 * | 11/2008 | Inoguchi | 451/5 |
| 2008/0033836 | A1 * | 2/2008 | Shinohara et al. | 705/26 |
| 2008/0218690 | A1 * | 9/2008 | Takeichi | 351/177 |

FOREIGN PATENT DOCUMENTS

| | | | |
|---|---|---|---|
| EP | 0 576 268 | A1 | 12/1993 |
| EP | 0 710 526 | A1 | 5/1996 |
| EP | 1 298 483 | A2 | 4/2003 |
| EP | 1 728 467 | A1 | 12/2006 |
| JP | 7-186027 | A | 7/1995 |

OTHER PUBLICATIONS

Extended European Search Report dated Feb. 12, 2008.

* cited by examiner

*Primary Examiner*—Jordan M. Schwartz
(74) *Attorney, Agent, or Firm*—Sughrue Mion, PLLC

(57) ABSTRACT

In a method of processing a periphery of an eyeglass lens, at an optician shop, rimless frame identifying data for identifying a rimless frame is inputted; modification data for an original target lens shape of the eyeglass lens to be mounted on the rimless frame is inputted; and the input rimless frame identifying data and modification data is transmitted through a network communication to a lens processing factory; and at the lens processing factory, the data transmitted is received through the network communication; the original target lens shape data of the eyeglass lens to be mounted on the rimless frame is called from a database, based on the received rimless frame identifying data; a modified target lens shape is calculated based on the original target lens shape and the modification data; and the periphery of the eyeglass lens is processed based on data the calculated modified target lens shape.

7 Claims, 7 Drawing Sheets

EYEGLASS LENS PROCESSING METHOD

BACKGROUND OF THE INVENTION

The present invention relates to an eyeglass lens processing method and an eyeglass lens processing system in which the information required for processing the eyeglass lenses is transmitted through a network communication such as the internet from an optician shop, and the lens processing side processes a periphery of the eyeglass lens, based on the transmitted information.

It is well known that the lens frame shape of an eyeglass frame having a bevel groove (lens groove) is measured by an eyeglass frame shape measuring instrument installed at an optician shop, the target lens shape data is transmitted to a lens factory, and a periphery of the eyeglass lens is intensively processed at the factory (e.g., refer to U.S. Pat. No. 6,379,215 (JP-A-2000-94283)).

In a rimless frame called a two-point or nylol frame (including a wire frame), unlike a metal frame having a lens groove around the entire periphery, the target lens shape can be modified. For example, in a progressive multifocal lens, the target lens shape can be extended in the lower direction so that the distance and near zones may be appropriately contained within the lens. Or the target lens shape may have the vertical width and the horizontal width of the target lens shape increased or decreased in fashionable manner. Therefore, a method for placing an order for processing the lens by modifying the target lens shape to the factory has been offered (e.g., refer to U.S. Pat. No. 6,142,628 (U.S. Pat. No. 3,250,184)).

By the way, in modifying the target lens shape of a lens mounted on the rimless frame, the target lens shape data modified at the optician shop can be transmitted to the factory, if there is original target lens shape data at the optician shop. However, if the original target lens shape data is not stored in the database, a dedicated on-line system has to be constructed to send for data from the maker. This needs a great capital investment. In the communication by mail transfer through the general provider of the internet connection service, it takes a long time to send for target lens shape data, so that an immediate action may not be taken.

Also, a demo lens mounted on the eyeglass frame may be removed, and measured by the eyeglass frame shape measuring instrument, in which the measured data is made original target lens shape data. However, this takes a lot of labor. Further, if the horizontal positioning of the demo lens is not appropriately made, the measured target lens shape may have an error in the horizontal direction. And the lens processed according to the target lens shape data may contain an axial dislocation.

Also, the nylol frame has a part that can not be modified. However, the operator of the optician shop is not easy to design a great-looking target lens shape modification in view of this part. In the two-point frame, it is not easy to appropriately set up the great-looking target lens shape modification or the hole position at which the frame is mounted.

SUMMARY OF THE INVENTION

It is a technical object of the present invention to provide an eyeglass lens processing method and its processing system in which modification data of target lens shape can be easily sent from the optician shop to the factory and the eyeglass lens of modified target lens shape can be appropriately processed at the factory without obtaining the original target lens shape data of a rimless frame.

In order to accomplish the above object, the invention has the following constitution.

(1) An eyeglass lens processing method of processing a periphery of an eyeglass lens, the method comprising the steps of:

at an optician shop, inputting rimless frame identifying data for identifying a rimless frame;

inputting modification data for an original target lens shape of the eyeglass lens to be mounted on the rimless frame; and transmitting the input rimless frame identifying data and modification data through a network communication to a lens processing factory;

at the lens processing factory, receiving the data transmitted through the network communication;

calling the original target lens shape data of the eyeglass lens to be mounted on the rimless frame from a database, based on the received rimless frame identifying data;

calculating a modified target lens shape based on the original target lens shape and the modification data; and processing the periphery of the eyeglass lens based on data the calculated modified target lens shape.

(2) The method according to (1), wherein the modification data includes data of at least one of up, down, right and left modification directions, and a modification amount for the original target lens shape.

(3) The method according to (2), wherein the calculation step includes a step of calculating the modified target lens shape by obtaining shift data of each point on the original target lens shape based on data of the modification amount, with inflection points on both sides orthogonal to the modification direction as start points of modification.

(4) The method according to (3), wherein the calculation step includes a step of calculating the modified target lens shape by obtaining a ratio of target lens shape modification based on data of a distance from the start point to the inflection point in the modification direction and the modification amount and obtaining shift data of each point between the start point and the inflection point in the modification direction based on the ratio.

(5) The method according to (2) further comprising calling points on both sides of a modifiable range on the original target lens shape from the database if the rimless frame identifying data is a nylol frame, wherein the calculation step includes a step of calculating the modified target lens shape by obtaining shift data of each point on the original target lens shape based on data of the modification amount, with the points on both sides of the modifiable range as start points of modification.

(6) The method according to (5), wherein the calculation step includes a step of calculating the modified target lens shape by obtaining a tangential direction at the start point of modification, obtaining a ratio of the target lens shape modification in a direction parallel to the tangential direction based on data of a distance from the start point to a inflection point in the modification direction and the modification amount and obtaining shift data of each point between the start point and the inflection point in the modification direction based on the ratio.

(7) The method according to (5), wherein the calculation step further includes a step of determining whether or not the modification data can be accepted, and transmitting an indication that modification data can not be accepted to the optician shop through the network communication if a direction out of the modifiable range is inputted as modification data.

DETAILED DESCRIPTION OF PREFERRED EMBODIMENTS

Figure 1:
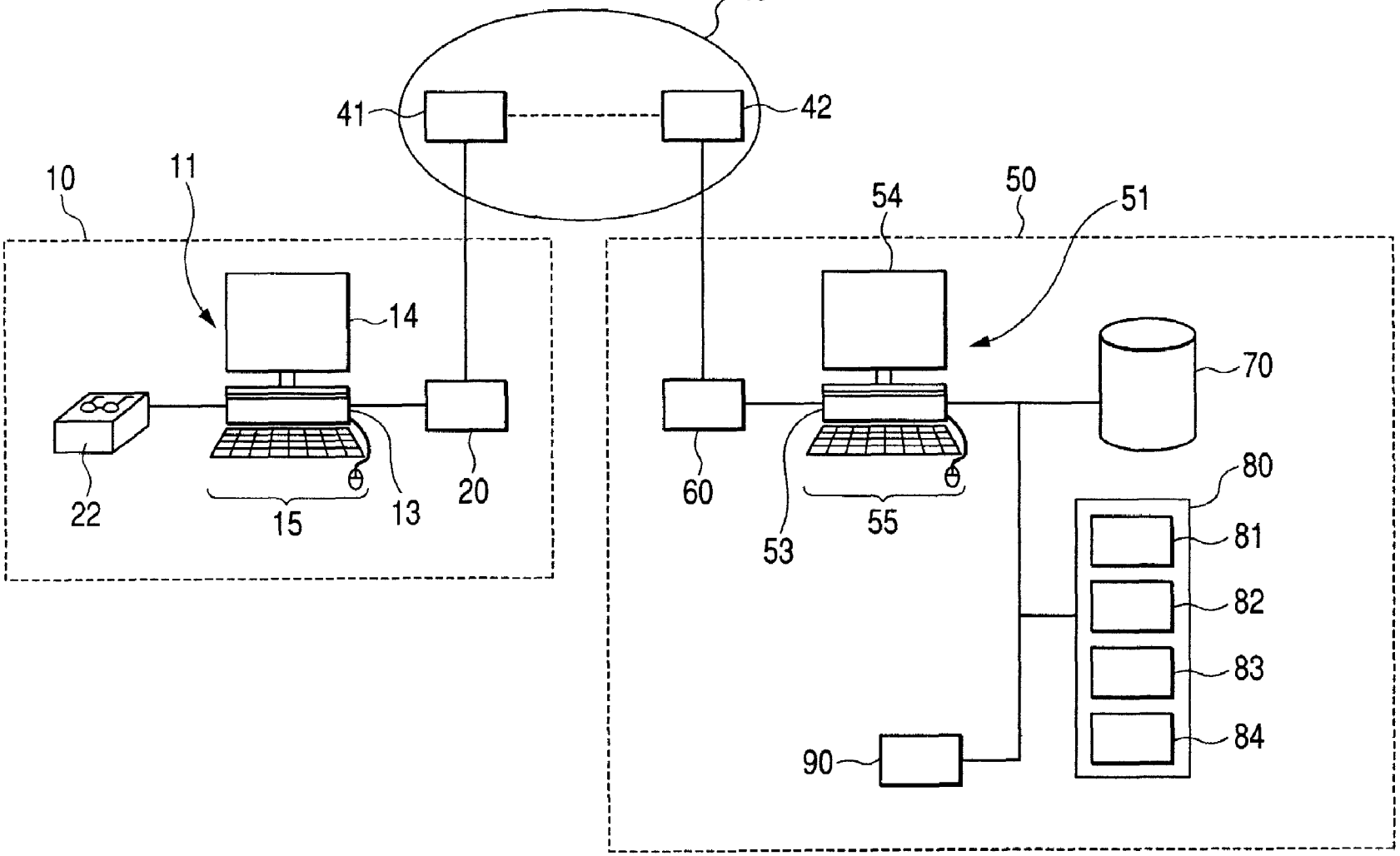
FIG. 1 shows an overall configuration view of an eyeglass lens communication processing system according to the present invention.

The embodiments of the present invention will be described below with reference to the drawings. FIG. 1 is an overall configuration view of an eyeglass lens communication processing system according to the present invention.

An optician shop 10 on the ordering side and a factory 50 of a lens maker for actually processing the lens are connected through the internet 40 as a network communication. In FIG. 1, only one optician shop 10 is shown as a representative. However, a plurality of optician shops 10 are actually connected to the factory 50.

A computer 11 (hereinafter referred to as an ordering PC 11) as a terminal unit used for ordering is installed at the optician shop 10. The ordering PC 11 is a personal computer. The ordering PC 11 comprising a main body 13 having a calculation processing function, a display 14 and an input unit 15 such as a keyboard. The display 14 may be employed as the input unit 15 by providing a touch panel function on the screen of the display 14. A router 20 is connected to the ordering PC 11. Also, the router 20 is connected to a mail server 41 of a provider (provider with which the optician shop 10 contracts) on the internet 40.

Also, an eyeglass frame shape measuring instrument 22 is connected to the ordering PC 11. A target lens shape of an eyeglass frame having a lens groove is measured by the eyeglass frame shape measuring instrument 22. And the measured data is inputted into the ordering PC 11. The eyeglass frame shape measuring instrument 22 can also measure the shape of a demo lens and a type plate mounted on the eyeglass frame. The well-known eyeglass frame shape measuring instrument 22 is usable (e.g., refer to U.S. Pat. No. 5,333,412 (JP-A-4-93164)).

A computer 51 (hereinafter an ordered-receiving PC 51) as an order accepting terminal unit is installed at the factory 50. The ordered-receiving PC 51 is a personal computer comprising a main body 53, a display 54 and an input unit 55 such as a keyboard. A router 60 is connected to the ordered-receiving PC 51. The router 60 is connected to a mail server 42 of a provider (provider with which the factory 50 contracts) on the internet 40.

A database 70, an eyeglass lens periphery processing device 80 and a blocker 90 are connected to the ordered-receiving PC 51. The ordered-receiving PC 51 also serves as a calculation control unit that calculates necessary data for processing and sends it to the processing device 80 and the blocker 90. This control unit may be provided separately from the ordered-receiving PC 51. Only one processing device 80 is shown is FIG. 1. However, a plurality of processing devices 80 are actually connected.

The database 70 stores a number of eyeglass frame information and lens information. The information stored in the database 70 includes original target lens shape data of a rimless frame (type in which no lens groove is formed over an entire periphery of the lens periphery such as a two-point frame and a nylol frame in this specification), mounting hole data (hole position, hole diameter, hole depth, etc.) on the lens in the two-point frame, groove data (groove width, groove depth, fixed position data in the case of target lens shape modification, etc.) in the nylol frame, and the non-modifiable range (or modifiable range) in the nylol frame. They are stored associated with the type number for identifying the eyeglass frame in the database 70.

The processing device 80 has a lens chuck shaft that chucks the eyeglass lens. And the processing device 80 comprises a lens periphery processing mechanism 81 for performing the roughing, bevel-finishing and flat-finishing for the periphery of the eyeglass lens held on the lens chuck shaft, a drilling mechanism 82 for drilling a hole for mounting the two-point frame on a retracting interface of lens, a grooving mechanism 83 for grooving the lens periphery subjected to the flat-finishing, and a lens shape measuring mechanism 84 for measuring the shape of fore side refracting interface and back side refracting interface of lens. This processing device 80 as described in U.S. Pat. No. 6,790,124 (JP-A-2003-145328), for example, can be employed. The drilling mechanism 82 and the grooving mechanism 83 can be constructed as another device from the lens periphery processing mechanism 81.

The blocker 90 has a mechanism for mounting a cup (jig for holding the lens on the lens chuck shaft of the processing device 80) on the front surface of lens based on the target lens shape data, and layout data of optical center with respect to the target lens shape center. Also, the blocker 90 has a mechanism for detecting the optical center of lens and an astigmatism axis direction. With this detection mechanism, a mark point of a lens meter can be omitted in mounting the cup (e.g. t refer to U.S. Pat. No. 6,798,501 (JP-A-2001-62688).

The ordering operation and the target lens shape modification operation for processing the lens in which the eyeglass frame is two-point frame and nylol frame.

<Ordering the Lens Processing with Original Target Lens Shape>

Before explaining the target lens shape modification, a case of ordering with the original target lens shape for a demo lens mounted on the two-point frame or nylol frame to the factory 50 (also requesting the processing) will be described below.

Figure 2:
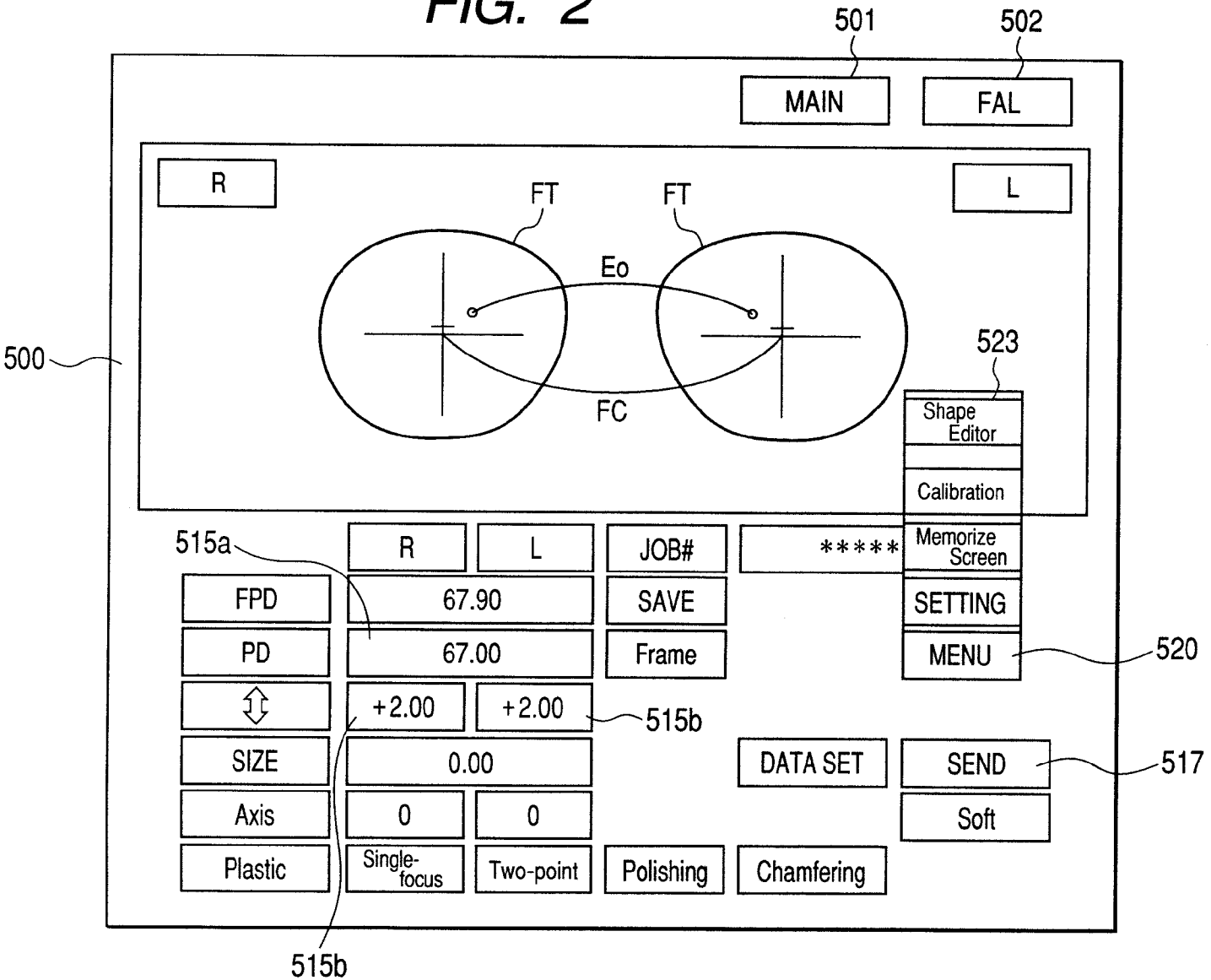
FIG. 2 shows a view for explaining an input screen for layout data and the processing conditions.

FIG. 2 shows a main input screen 500 for inputting the layout data and the processing conditions which are displayed on the display 14 of the ordering PC 11. When the demo lens or type plate mounted on the two-point frame or nylol frame is measured by the eyeglass frame shape measuring instrument 22, the target lens shape graphics FT are displayed on the upper part of a main screen. Or if the original target lens shape is stored in the main body 13, the original target lens shape is called. However, in the two-point frame or nylol frame, the original target lens shape of that frame is stored in the database 70 of the factory 50. Therefore, the target lens shape data may not be provided at the optician shop 10. In this case, layout data can be inputted even if the target lens shape data is not displayed. As the sample data, the target lens shape graphics FT approximate to the target lens shape of the frame selected by the wearer may be called from the memory of the main body 13 and displayed.

As the layout data, a PD value (pupil-to-pupil distance) of the wearer is inputted into an input field 515*a*. Further, the height of an optical center Eo relative to the geometric center FC of the target lens shape is inputted into an input field 515*b*. An FPD (distance between right and left frame centers), which is stored as frame information in the database 70 of the factory 50, is usable.

Also, the processing conditions including the lens material, target lens shape (fixed focal length lens, bifocal lens, graduated lens etc.), frame type (metal, call, two-point, nylol, etc.), presence or absence of polishing, presence or absence of chamfering can be inputted by using the buttons on the lower part of the screen.

Figure 3:
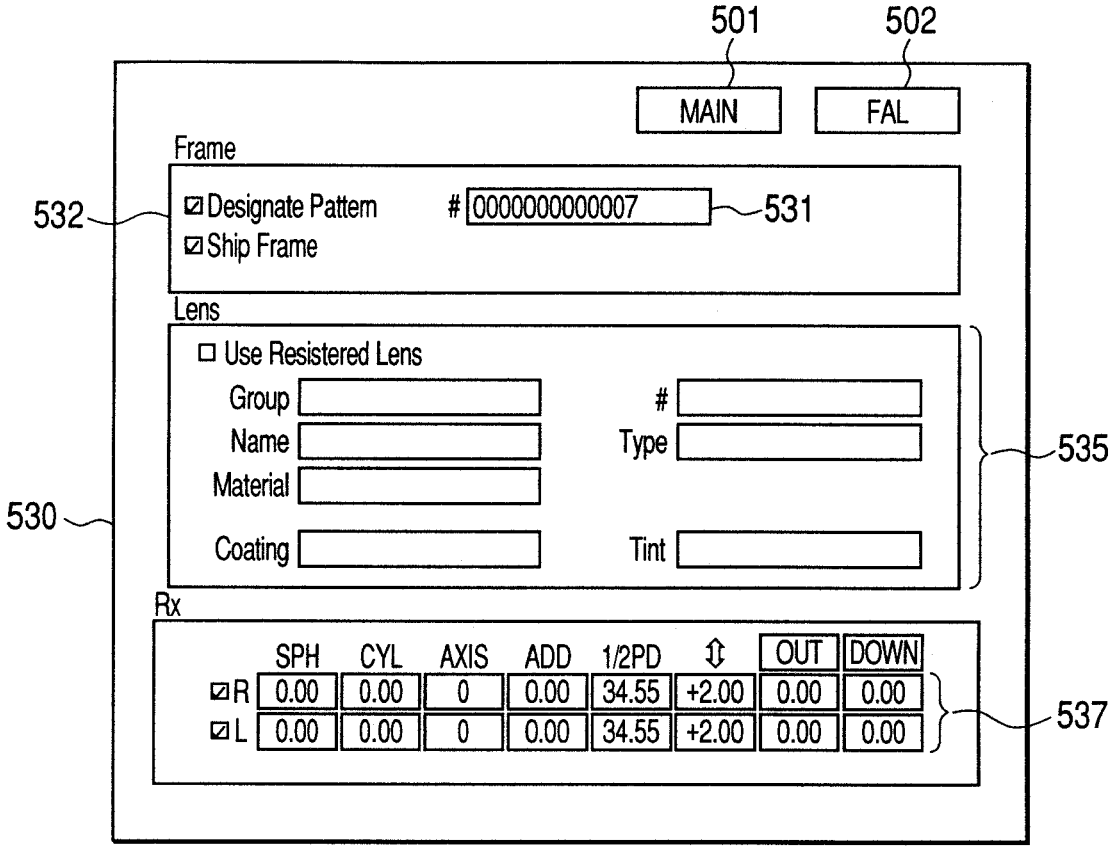
FIG. 3 shows a view for explaining an input screen for frame designation information and so forth.

FIG. 3 shows an input screen 530 for inputting the prescribed values such as information identifying the frame, target lens shape, and lens power. This input screen 530 is displayed by pressing the button 502 on the screen. In FIG. 3, the frame maker and its type number as identifying information of frame can be inputted from an input field 531. If the frame is dispatched from the optician shop 10 to the factory 50, and an order of assembling the processed lens into the frame is placed to the factory 50, an input field 532 is checked. Also, the type, material and coating of the ordered lens can be inputted into the input fields 535. The prescribed powers (spherical power, cylindrical power, axial angle etc.) of the right and left lenses can be inputted in the input fields 537.

After the required ordering data is inputted, the main screen 500 is displayed by the button 501 (see FIG. 2). If a send button 517 on the screen is pressed, the ordering data is sent from the ordering PC 11 to the mail server 41. Further, it is delivered to the mail server 42 in accordance with the registered mail address of the factory 10. The ordering data stored in the mail server 42 is sent to the ordered-receiving PC 51 when the ordered-receiving PC 51 at the factory 50 gains access to the mail server 42.

If the ordering data is received by the ordered-receiving PC 51, the original target lens shape data and FPD stored in the database 70 are specified based on the identifying information of frame. Also, in the case of the two-point frame, hole data is specified. And these data are sent to the processing device 80. At the processing device 80, the target lens shape processing data and drilling data are calculated based on the sent data, whereby the lens periphery processing and drilling are performed. Also, in the case of the nylol frame, groove data is called from the database 70. At the processing device 80, the target lens shape processing data and grooving data are calculated based on the sent data, whereby the lens periphery processing and grooving are performed.

<Ordering Lens Processing with Target Lens Shape Modification>

A case where the original target lens shape of two-point frame or nylol frame is modified and the lens processing is ordered to the factory 50 will be described below.

Figure 4:
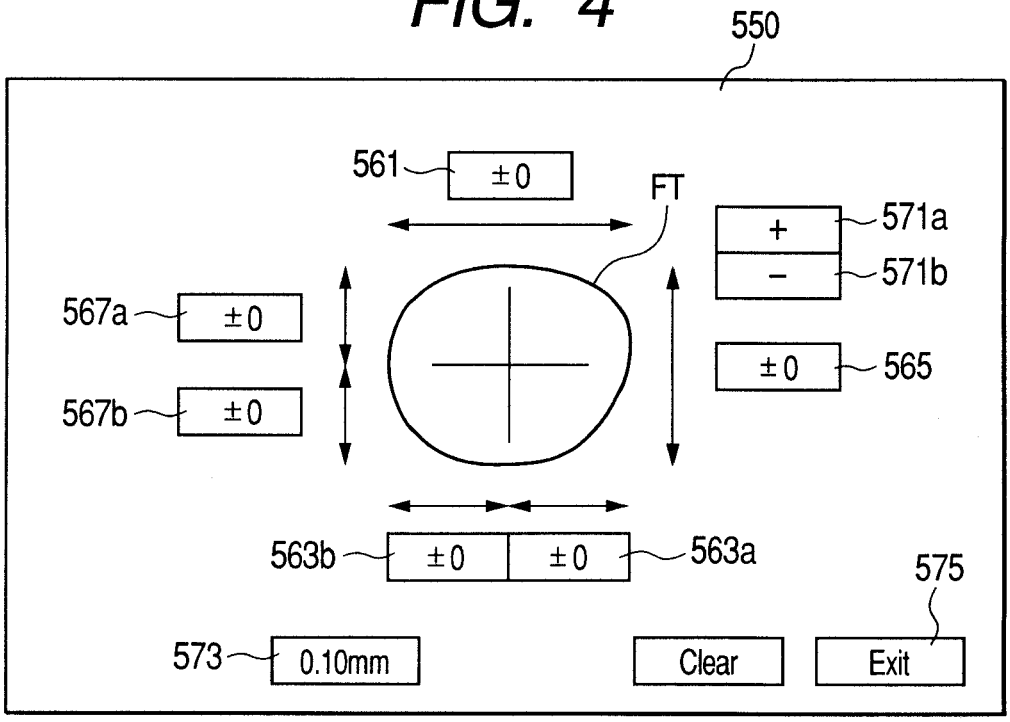
FIG. 4 shows a view for explaining an input screen for inputting target lens shape modification data.

FIG. 4 shows an input screen 550 for inputting the target lens shape modification data. This input screen 550 is displayed by selecting a target lens shape modification button 523 in the menu field that pops up when the menu button 520 is selected on the main input screen 500.

The target lens shape modification screen 550 is provided with an input field 561 for changing the size of entire breadth (in the lateral direction), an input field 563*a* for changing the size of horizontal length (in the right direction) on the nose side, an input field 563*b* for changing the size of horizontal length (in the left direction) on the ear side, an input field 565 for changing the size of entire length (in the vertical direction), an input field 567*a* for changing the size of upper length (in the upper direction), and an input field 567*b* for changing the size of lower length (in the lower direction) for the original target lens shape. Herein, since the original target lens shape data is unknown, the operator inputs each of the longitudinal and transversal directions (vertical and horizontal directions) of the target lens shape modification for the or original target lens shape size, and the modification amount (increase amount/decrease amount) in each direction. The target lens shape graphic FT on the screen is sample target lens shape here. The sample target lens shape can be called by selecting the closest target lens shape from among the target lens shapes stored in the ordering PC 11. Or though the operation is slightly troublesome, the demo lens mounted on the rimless frame may be measured by the eyeglass frame shape measuring instrument 22 and the target lens shape data nay be used.

The input of modification amount into each input field may be made by checking each input field after designating a plus button 571*a* or minus button 571*b*. Thereby, the change amount can be increased or decreased at a predetermined step width D. The step width D can be set to 0.10 mm, 0.25 mm or 0.50 mm by a button 573.

For example, an instance where the vertical width of the target lens shape of the two-point frame or nylol frame selected by the wearer is narrow will be described below. At this time, a near zone of the prescribed progressive multifocal lens may not be included in its target lens shape. This problem can be treated by extending the original target lens shape in the lower direction by 3 mm. In this case, "+3.00 mm" is inputted into the input field 567*b* in FIG. 4.

If the operator presses an EXIT button 575 after completing the input, the input data is stored in a memory of the ordered-receiving PC 51. And the screen of the display 14 is switched to the main input screen 500. On the main input screen 500, the PD value of the wearer, and the height data of the optical center with respect to the geometric center FC of the original target lens shape are inputted as the layout data, like the original target lens shape. The FPD which is stored associated with the identifying information of the frame in the database 70 of the factory 50 can be used, and is unnecessary to input. The processing conditions include the lens material, target lens shape, frame type, presence or absence of polishing, and presence or absence of chamfering are inputted by using the buttons on the lower part of the screen. Also, the ordering data can be inputted by inputting the prescribed values such as the identifying information of frame (maker and type number of frame), target lens shape and lens power on the input screen 530 of FIG. 3.

If the send button 517 is pressed in FIG. 2, the ordering data such as the inputted target lens shape modification data, identifying information of frame and so forth is appended from the ordered-receiving PC 11 to the mail. And the mail is transmitted through the internet 40 to the ordered-receiving PC 51 at the factory 10. And on the ordered-receiving PC 51, the original target lens shape data stored in the database 70 is called based on the identifying information of frame, and a calculation process for target lens shape modification is performed based on the target lens shape modification data.

Figure 5:
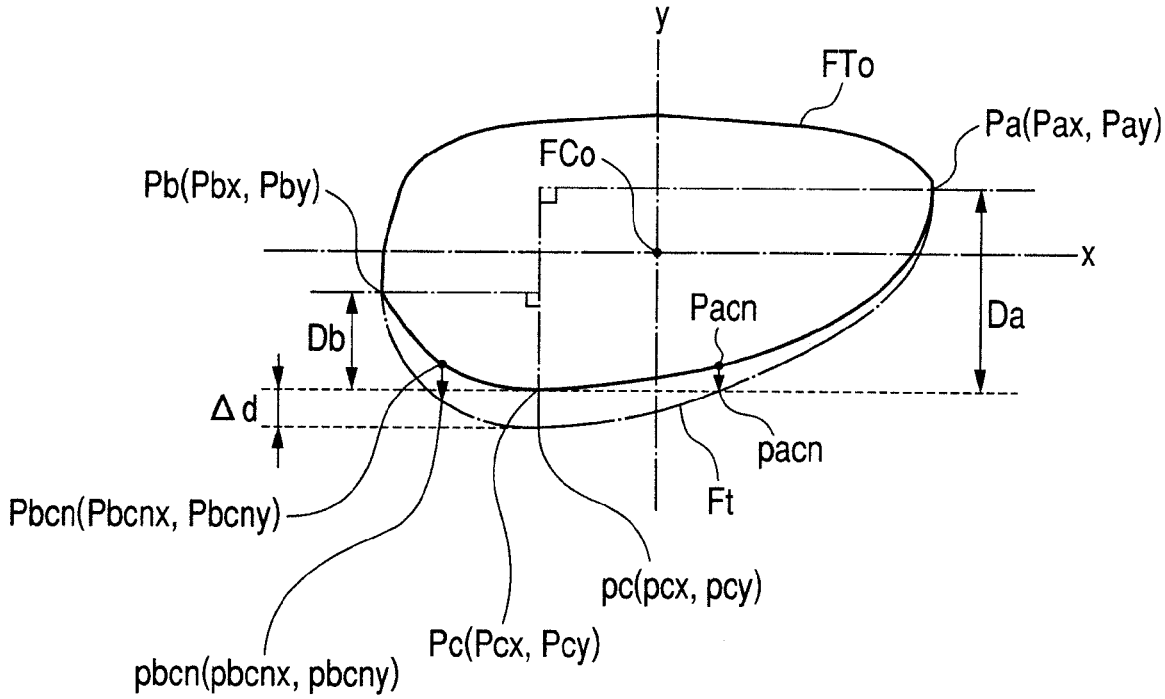
FIG. 5 shows a view for explaining the target lens shape modification of a two-point frame.

The calculation process for target lens shape modification will be described below. For example, it is supposed that the two-point frame is designated as the frame type, and the multi-focal lens is designated as the target lens shape. And to treat the multi-focal lens, it is supposed that data of the original target lens shape lengthened by Δd (mm) in the lower direction is set as the modification amount data of target lens shape modification. FIG. 5 shows a target lens shape modification process at this time.

In FIG. 5, it is assumed that the target lens shape center (geometric center) of the original target lens shape FTo as indicated by the solid line is FCo. Supposing FCo as an origin of the xy coordinates, the x coordinate is taken in the transverse direction (horizontal direction), and the y coordinate is taken in the vertical direction. It is assumed that the point (right inflection point) at which the x coordinates of the target lens shape FTo is maximum is Pa(Pax, Pay). Also, it is assumed that the point (left inflection point) at which the x coordinate is minimum is Pb(Pbx,Pby). Also, it is assumed that the point (lower inflection point) at which the y coordinate is minimum is Pc (Pcx, Pcy). It is assumed that the point to which the point Pc is moved by a modification amount Δd in the lower direction of the y coordinate is pc(pcx, pcy).

First of all, it is supposed that the start point when the point Pc is moved to the point pc is the inflection point Pa in the direction orthogonal to the lower direction. And each point between point Pa and point Pc is moved in the y axis direction. A modification ratio ka at this time is the ratio of the distance between point Pa and point pc to the distance between point Pa and point Pc in the y axis direction. That is, the ratio ka is represented by $$\begin{aligned} ka &= (pcy - Pay)/(Pcy - Pay) \\ &= (\Delta d + Pcy - Pay)/(Pcy - Pay) \\ &= \Delta d/(Pcy - Pay) + 1 \end{aligned}$$

(Pcy−Pay) is the distance Da between point Pa and point Pc in the y axis direction. At this ratio ka, the point Pacn(Pacnx, Pacny) on the target lens shape FTo between point Pa and point Pc is moved in the lower direction of the y axis. Thereby, the modified point pacn (pacnx, pacny) is obtained as $$pacnx = Pacnx$$

$$pacny = (Pacny - Pay) \times ka + Pay$$

This computation is performed at each point on the target lens shape FTo between point Pa and point Pc. Thereby, the target lens shape modification between point Pa and point Pc is obtained as indicated by the chain double-dashed line Ft.

The same computation is performed between point Pb and point Pc. It is supposed that the start point of modification is the inflection point Pb in the direction orthogonal to the lower direction. And each point between point Ph and point PC is moved in the y axis direction, A modification ratio kb at this time is the ratio of the distance between point Pb and point pc to the distance between point Pb and point Pc in the y axis direction. The ratio kb is represented by $$\begin{aligned} kb &= (pcy - Pby)/(Pcy - Pby) \\ &= (\Delta d + Pcy - Pby)/(Pcy - Pby) \\ &= \Delta d/(Pcy - Pby) + 1 \end{aligned}$$

(Pcy−Pby) is the distance Db between point Pb and point Pc in the y axis direction. At this ratio kb, the point Pbcn(Pbcnx, Pbcny) on the target lens shape FTo between point Pb and point Pc is moved in the lower direction of the y axis. The modified point pbcn (pbcnx, pbcny) is obtained as $$pbcnx = Pbcnx$$

$$pbcny = (Pbcny - Pby) \times kb + Pby$$

This computation is performed at each point on the target lens shape FTo between point Pb and point PCB. Thereby, the target lens shape modification between point Pb and point Pc is obtained as indicated by the chain double-dashed line Ft.

As described above, with the modification of Δd in the lower direction, the point is modified downwards with the inflection points Pa and Pb as the start points of modification. Thereby, the modified target lens shape Ft has a smooth shape without concavity and distortion. A case where the points (not inflection point) on the target lens shape FTo through which the x axis passes are the start points of modification with reference to the target lens shape center FCo will be described below. At this time, in the point is simply modified downward (in the y axis direction), the start point is depressed, and the shape does not become smooth. On the contrary, the great-looking target lens shape modification is allowed by the above method.

A case of modifying the point by the modification amount Δd in the lower direction has been described above. When the point is changed in the upper direction, left transverse direction or right transverse direction, the modified target lens shape can be obtained through the same calculation process.

With the above method, the operator at the optician shop may send the modification direction and its modification amount as the target lens shape modification data to the factory without having the original target lens shape data.

Figure 6:
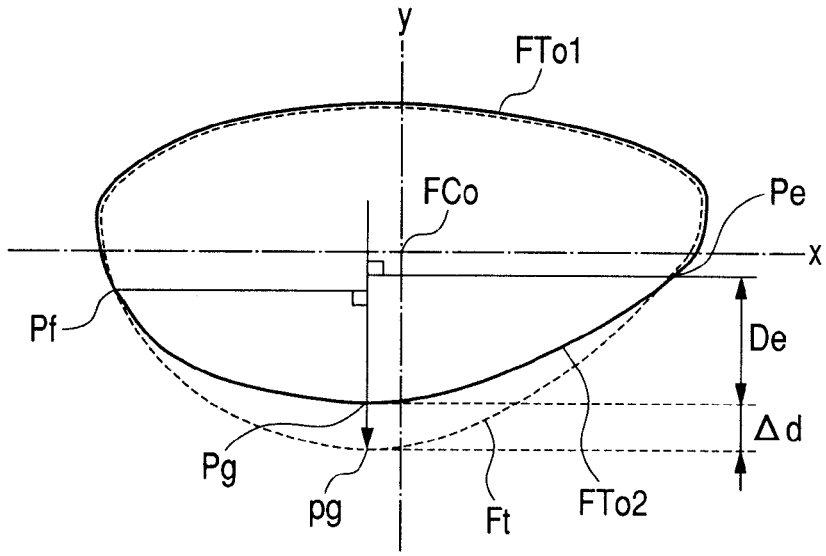
FIG. 6 shows a view for explaining the target lens shape modification of a nylol frame.

Next, a case where the nylol frame is designated as the frame type will be described below, FIG. 6 is a view for explaining the calculation process for target lens shape modification of the nylol frame. In the nylol frame, the rim part is a non-modifiable range. Therefore, the modifiable range is the area excluding the rim part. In FIG. 6, the rim part is the part of the upper area FTo1 from point Pe to point Pf on the original target lens shape. And the lower area FTo2 is the modification area. This modifiable range data is stored in the database 70 together with the original target lens shape in connection with the identifying information of the frame. Accordingly, the points Pe and Pf at both ends of the modifiable range FTo2 are called from the database 70 if the nylol frame is designated, And the data lengthened by Δd (mm) in the lower direction of the original target lens shape is set as the modification amount data of target lens shape modification.

In FIG. 6, it is assumed that the target lens shape center FCo of the original target lens shape is the origin of the xy coordinates. And the x coordinate is taken in the transverse direction (horizontal direction), and the y coordinate is taken in the vertical direction. It is assumed that the point (lower inflection point) at which the y coordinate on the modification area FTo2 is minimum is Pg. Also, it is assumed that, the point to which the point Pg is moved by the modification amount Δd in the lower direction of y axis is pg.

Figure 7A:
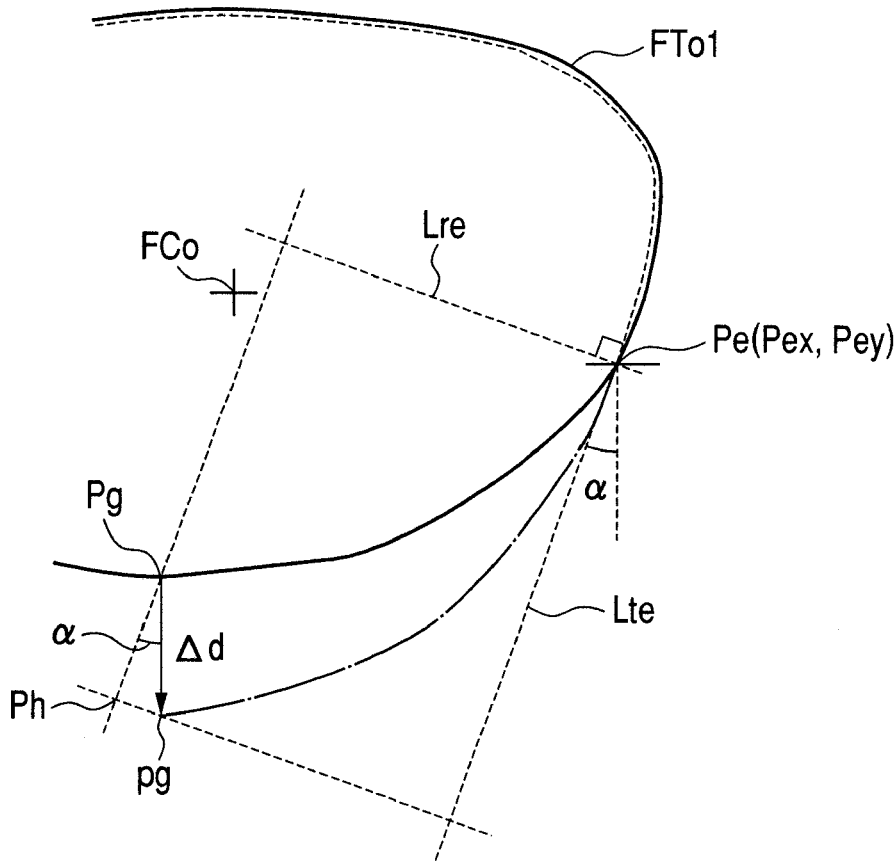
FIGS. 7A and 7B show views of enlarging the essential part of the target lens shape modification of the nylol frame.

FIG. 7A is a view for explaining the modification of the area from point Pe to point Pg. The point Pe is not the right inflection point at which the x coordinate is maximum. Therefore, if the point is directly modified at the ratio in the y axis direction (see the explanation of FIG. 5), a concavity occurs in the modified shape at the point Pe. Thus, first of all, the modification in the direction parallel to the tangential line Lte at the point Pe is considered. And each point between point Pe and point Pg is moved in accordance with the ratio of modification (in the same way of thinking as in FIG. 5) In this case, since the x component of each point is changed, a torsion with the left point of point Pg occurs. Therefore, each point may be contracted at the ratio of modification in the direction parallel to the straight line Lre (vertical line of the tangential line Lte) with reference to the tangential line Lte (in the same way of thinking as in FIG. 5).

Figure 7B:
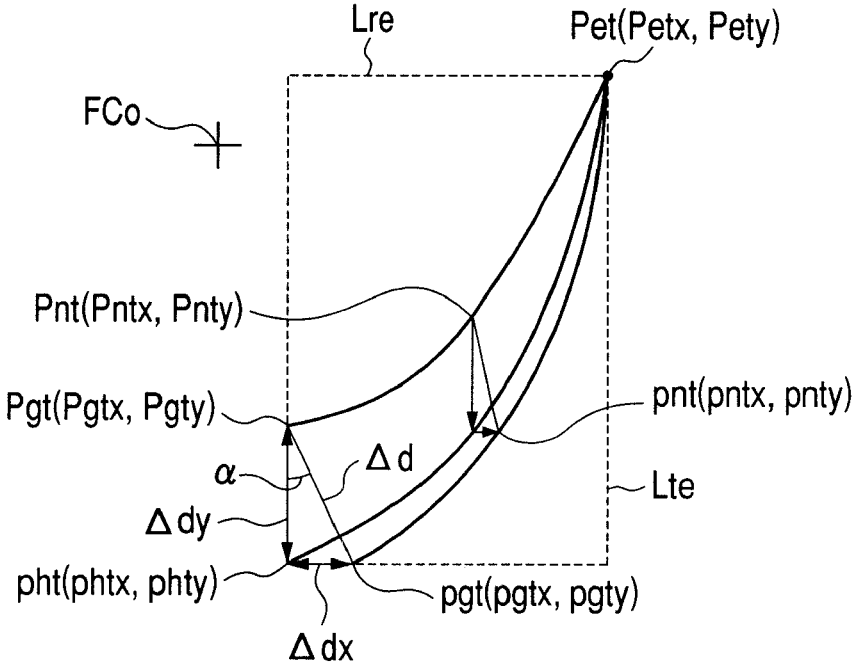

Herein r to simplify the computation, firstly, each point of the entire target lens shape is rotated by angle α (angle of the tangential line Lte to the y axis direction) with reference to the target lens shape center FCo. And the translation occurs so that the tangential line Lte may be parallel to the y axis as shown in FIG. 7B. It is assumed that the points after translating the points Pe, Pg and pg are points Pet(Petx,Pety), Pgt (Pgtx,Pgty) and pgt(pgtx,pgty). In FIG. 7B, the point pht (phtx,phty) is the point to which the point Pgt is changed in the direction of tangential line Lte. The point Pgt is finally moved to the point pgt. Therefore, it is considered that the point Pgt is moved to the point pht in the first modification. The distance of line segment Pgt-pgt is the modification amount Δd. Hence, the movement amount Δdy from the point Pgt to point pht is $$\Delta dy=\Delta d\times\cos\alpha$$

A change ratio kehy of the point Pet-point pht to the point Pet-point Pgt in the y axis direction is $$kehy=(phty-Pety)/(Pgty-Pety)=\Delta d\times\cos\alpha/(Pgty-Pety)+1$$

Accordingly, the y coordinate of the point pnt (pntx,pnty) to which the point Pnt (Pntx, Pnty) on the target lens shape between point Pet and point Pgt is moved at the ratio kehy is $$pnty=(Pnty-Pety)\times kehy+Pety$$

Next, the movement front the point pht to the point pgt is considered. At this time, the movement amount Δdx is $$\Delta dx=\Delta d\times\sin\alpha$$

Assuming that the change ratio of the point Pet-point pgt to the point Pet—point pht in the x axis direction is khgx, $$\text{phtx}=\text{Pgtx}$$

$$pgtx=phtx+\Delta dx$$

Therefore, $$khgx=(pgtx-Petx)/(phtx-Petx)=1+\Delta d\times\sin\alpha/(phtx-Petx)$$

The x coordinate of the point pnt (pntx, pnty) to which the point Pnt is moved is $$pntx=(Pntx-Petx)\times khgx+Petx$$

And if the coordinate of each point pnt after movement is rotated by angle α with reference to the target lens shape center FCo and restored, the coordinate after target lens shape modification between point Pe and point pg is obtained.

The modification of the area from remaining point Pf to point Pg is firstly considered in the direction parallel to the tangential line at the point Pf. And each point between point Pf and point Pg is moved by applying the same calculation method, so that the modified target lens shape is obtained.

As described above, in the nylol frame, the predetermined modifiable range data on the original target lens shape is called from the database. And the modified target lens shape is calculated with both ends as the start points of modification. At this time, the modification is once calculated in the direction parallel to the tangential direction (Lte) at the modification start point. Thereafter, the modification to the vertical direction (direction parallel to the straight line Lre) of the tangential direction Lte is calculated. Thereby, the modified target lens shape has a smooth shape without concavity at both ends in the modifiable range. Also, the point (pg) to which the inflection point (Pg) is moved downward in the modification direction also maintains the inflection point in the lower direction. Therefore, the great-looking target lens shape modification is allowed. The operator of the optician shop does not need to make conscious of the modifiable range in inputting the modification data of the nylol frame. The operator can easily send the modification data of target lens shape to the factory by simply inputting the modification direction and its modification amount.

Figure 8:
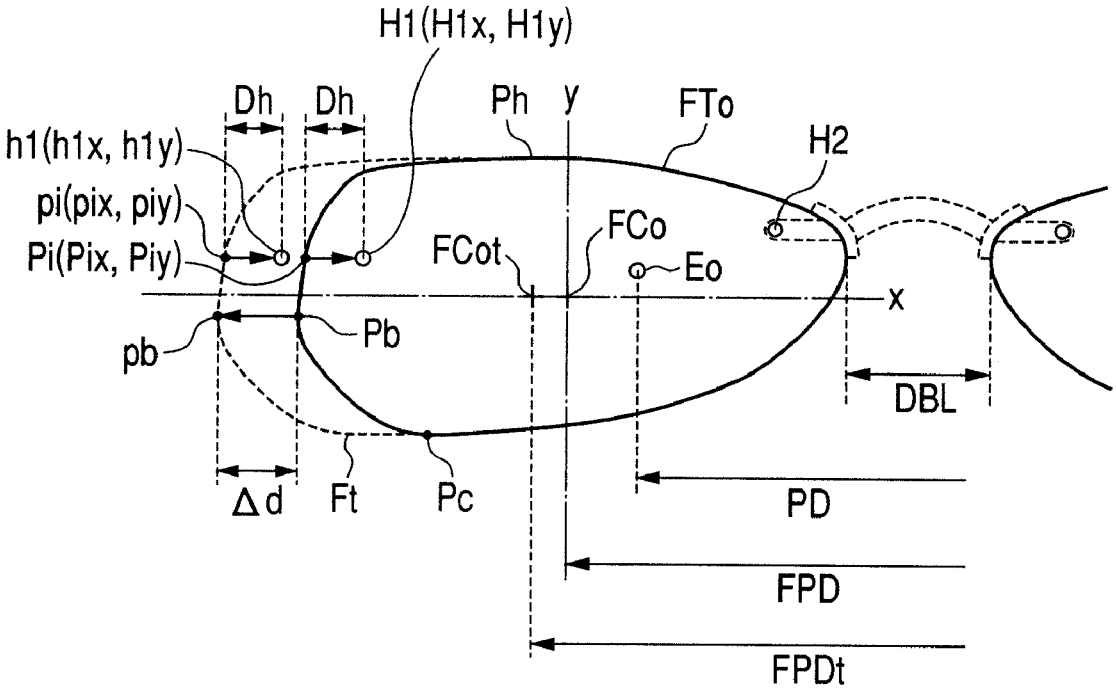
FIG. 8 shows a view for explaining a processing for hole positions in the target lens shape modification of the two-point frame.

Next, a characteristic process for the hole position and the center distance of target lens shape when the target lens shape for the two-point frame is modified will be described below. For example, it is supposed that the target lens shape modification data is set to extend the original target lens shape FTo by the modification amount Δd in the transverse direction on the ear side as shown in FIG. 8. In FIG. 8, the xy coordinates are set with reference to the target lens shape center FCo of the target lens shape FTo. A method for target lens shape modification is the inflection point Pa at which the y coordinate of the target lens shape FTo is minimum and the inflection point Ph at which the y coordinate is maximum are the start points of modification in the same way as in FIG. 5. And the inflection point Pb at which the x coordinate is minimum is moved by the modification amount Δd to the point pt in the left transverse direction, whereby the modified target lens shape Ft is calculated.

By the way, in the case where the two-point frame is an endpiece type (type in which a detent member is contacted with the outer peripheral edge of lens), or the type in which the lens edge is formed with a notch (cutout), the hole position often refers to the edge of lens. For example, the hole position H1 (H1$x$, H1$y$) is set at the position off distance Dh in the plus direction of the x axis with reference to the edge point Pi (Pix, Piy) of the original target lens shape FTo in the horizontal direction to the x axis. This hole position data's stored in the database 70 together with the original target lens shape based on the frame information.

With the target lens shape modification, it is assumed that the point on the target lens shape Ft to which the point Pi(Pix, Piy) is moved is pi (pix, piy). At this time, the modified hole position is set at the position h1 (h1$x$, h1$y$) off distance Dh in the plus direction of the x axis with reference to this point pi. That is, when the target lens shape edge on which the hole position is based is moved due to modification, the hole position is also moved according to its modification. In this manner, the coordinates of the hole position h1 after target lens shape modification are recalculated.

In FIG. 8, FCot is the geometric center of the modified target lens shape Ft. The modified target lens shape Ft is subjected to the coordinate transformation with the reference to the center FCot. The left target lens shape is obtained as the shape of mirroring the right target lens shape Ft to the left or right. The center distance FPDt between the right and left target lens shapes is recalculated from the center distance FPD (stored associated with the identifying information of the frame in the database 70) of original target lens shapes based on the modification amount d. Also, the layout position of the optical center Eo of lens for the modified target lens shape Ft is transformed so that the positional relation to the center FCo of the original target lens shape may be unchanged. Thereby, the hole position h1 after target lens shape modification and the position of the optical center Ec are appropriately managed. The center distance FPDt between the right and left target lens shapes after target lens shape modification is also appropriately managed.

Figure 9:
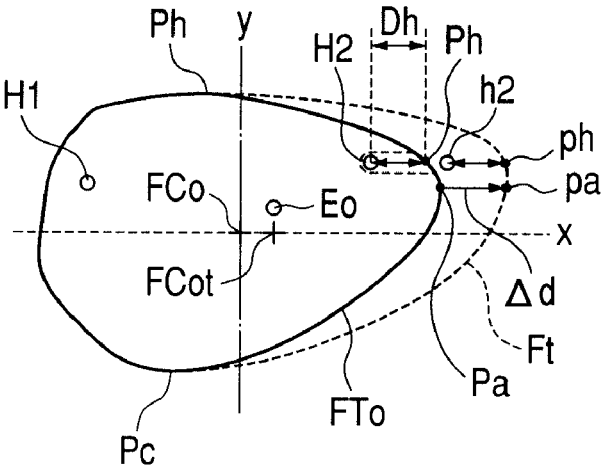
FIG. 9 shows a first view for explaining the modification of the two-point frame on the nose side.

FIG. 9 is shows a case where the target lens shape modification data is set to extend the original target lens shape FTo by the modification amount Δd in the transverse direction on the nose side. In this case, the modified target lens shape Ft is obtained, with the lower inflection point Pc and the upper inflection point Ph as the start points of modification, so that the inflection point Pa of the x coordinate may be extended by the modification amount Δd. And the target lens shape edge with reference to the hole position is moved for the hole position H2 on the nose side due to modification. Therefore, the hole position H2 is also moved to the hole position h2 according to the modification. Also, the target lens shape center FCot of the modified target lens shape Ft is recalculated based on the modified target lens shape Ft.

Figure 10:
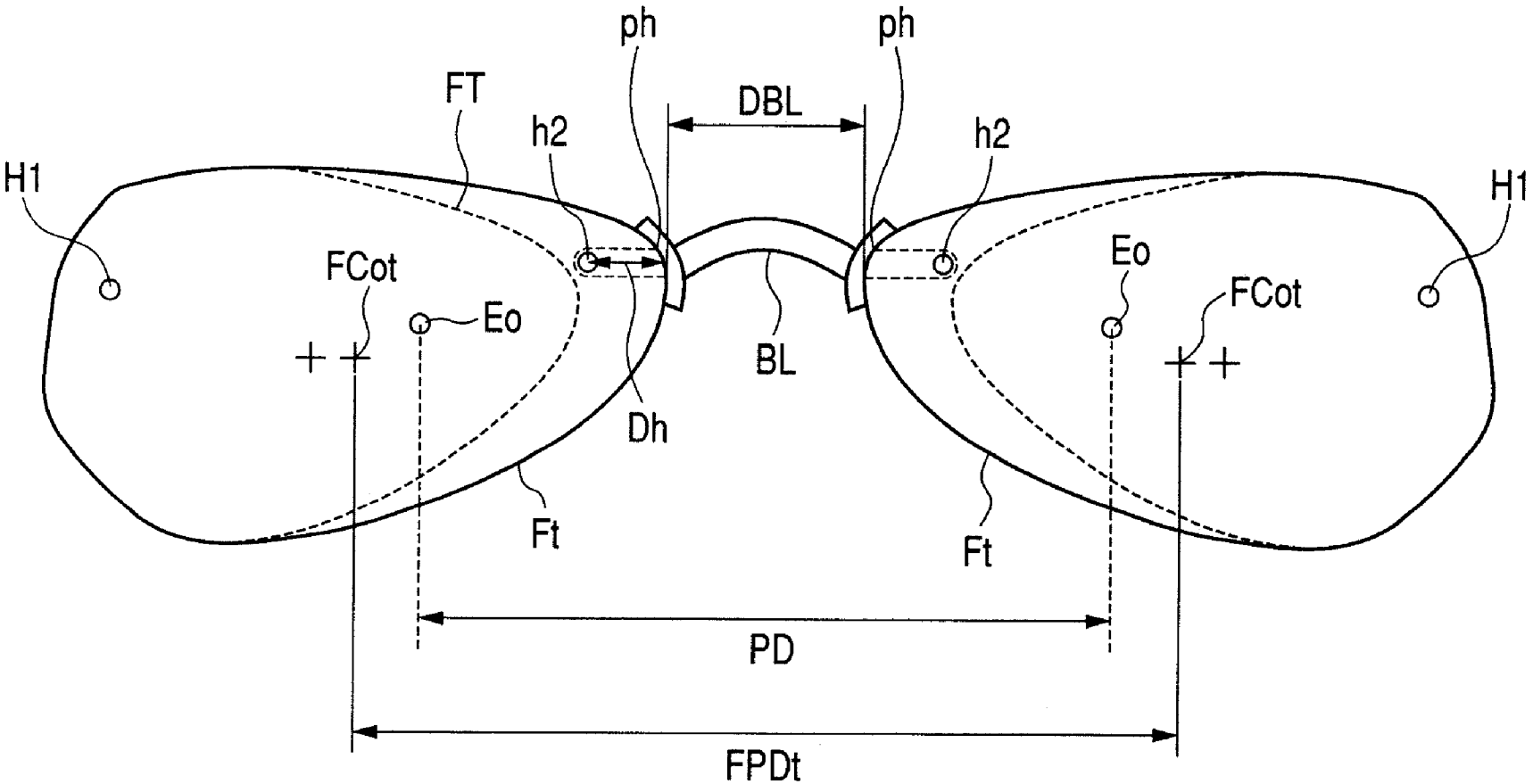
FIG. 10 shows a second view for explaining the modification of the two-point frame on the nose side.

Herein, in FIG. 8 (modification on the ear side) as previously described, the hole position H2 on the nose side is not changed with respect to the center FCo of the original target lens shape. Therefore, for the modified target lens shape center FCot, the center distance FPDt between the right and left target lens shapes only considers the change amount of the original target lens shape FT with respect to the FPD. On the contrary, in FIG. 9, when the hole position H2 on the nose side is changed to the hole position h2 in accordance with the target lens shape modification the computation in consideration of this is required. That is, the right and left lenses are connected by a bridge BL in the two-point frame as shown in FIG. 10. Even if the target lens shape is modified on the nose side, it is required that the nose side distance DBL (or distance between right and left hole positions h2) of the right and left lenses (target lens shapes) connected by the bridge BL is not changed before and after modification of target lens shape. The target lens shape center distance FPDt after target lens shape modification is obtained as the distance between the right and left target lens shape centers FCot in the state the modified target lens shape Ft is arranged while maintaining the distance DBL. For example, if the setting reference of the hole position H2 is the target lens shape edge position Ph in the horizontal direction, the arrangement of the target lens shape Ft with the bridge BL is decided with reference to the edge position ph of the modified target lens shape Ft. Also, the hole position h2 is set at the position the distance Dh away from the edge position ph.

Also, if the target lens shape center FCot after target lens shape modification is obtained, the layout data of the optical center Eo to the target lens shape center FCot after target lens shape modification is computed based on the center distance FPDt between the right and left target lens shapes and PD (pupil-to-pupil distance of the wearer) and the height data of the optical center Eo (which is height data from the target lens shape center FCo of the original target lens shape FT) transmitted from the optician shop 10. This result is displayed on the display 54. The modified target lens shape data and the layout data are transmitted to the processing device 80 and a blocker 90. In the blocker 90, the modified target lens shape data and the layout data are used as guide data in fixing (aligning) a cup.

In the case of the nylol frame as shown in FIG. 6, it is not modifiable in the x axis direction due to a limitation by the upper area FTo1. However, if an indication of modification in the x axis direction is transmitted from the optician shop 10 to the factory 50, it is reported by mail to the optician shop 10 that the modification can not be accepted.

In processing the lens with the processing device 80, the modified target lens shape data and the layout data are inputted into the processing device 80. In the case of the two-point frame, in the processing device 80, the lens shape measuring mechanism 84 measures the edge position of the front face and back face of lens, based on the target lens shape data. Also, the hole position of the front face of lens is measured based on the hole position data. After the lens periphery processing mechanism 81 performs the flat-processing on the periphery of lens based on the target lens shape data, the drilling mechanism 82 drills the hole based on the drilling data. In the case of the nylol frame, a grooving locus for groove processing is calculated based on the edge position data of the front face and back face of lens by the lens shape measuring mechanism 84. After the flat processing of the lens periphery by the lens periphery processing mechanism 81, the groove is processed on the periphery of lens by the grooving mechanism 83, based on the grooving locus and the groove related information such as the groove depth and groove width called from the database 70.

The processed lens is delivered to the optician shop, based on the ordering data. When the eyeglass frame is sent to the factory 50 or the eyeglass frame itself is ordered, the processed lens is assembled and delivered.

What is claimed is:

1. An eyeglass lens processing method of processing a periphery of an eyeglass lens, the method comprising the steps of:

at an optician shop, inputting rimless frame identifying data for identifying a rimless frame;

inputting modification data for an original target lens shape of the eyeglass lens to be mounted on the rimless frame; and transmitting the input rimless frame identifying data and modification data through a network communication to a lens processing factory;

at the lens processing factory, receiving the data transmitted through the network communication;

calling the original target lens shape of the eyeglass lens to be mounted on the rimless frame from a database, based on the received rimless frame identifying data;

calculating a modified target lens shape based on the called original target lens shape and the received modification data; and processing the periphery of the eyeglass lens based on the calculated modified target lens shape.

2. The method according to claim 1, wherein the modification data includes data of at least one of up, down, right and left modification directions, and a modification amount for the original target lens shape.

3. The method according to claim 2, wherein the calculation step includes a step of calculating the modified target lens shape by obtaining shift data of each point on the original target lens shape based on the data of the modification amount, with inflection points on both sides orthogonal to the modification direction as start points of target lens shape modification.

4. The method according to claim 3, wherein the calculation step includes a step of calculating the modified target lens shape by obtaining a ratio of the target lens shape modification based on data of a distance from the start point to an inflection point in the modification direction and the modification amount and obtaining shift data of each point between the start point and the inflection point in the modification direction based on the ratio.

5. The method according to claim 2 further comprising calling points on both sides of a modifiable range on the original target lens shape from the database if the rimless frame identifying data is a nylol frame, wherein the calculation step includes a step of calculating the modified target lens shape by obtaining shift data of each point on the original target lens shape based on the data of the modification amount, with the points on both sides of the modifiable range as start points of target lens shape modification.

6. The method according to claim 5, wherein the calculation step includes a step of calculating the modified target lens shape by obtaining a tangential direction at the start point, obtaining a ratio of the target lens shape modification in a direction parallel to the tangential direction based on data of a distance from the start point to an inflection point in the modification direction and the modification amount and obtaining shift data of each point between the start point and the inflection point in the modification direction based on the ratio.

7. The method according to claim 5, wherein the calculation step further includes a step of determining whether or not the modification data can be accepted, and transmitting an indication that the modification data can not be accepted to the optician shop through the network communication if a direction out of the modifiable range is inputted as modification data.

* * * * *